US005802979A

United States Patent [19]

Lovison

[11] Patent Number: 5,802,979

[45] Date of Patent: Sep. 8, 1998

[54] METHOD FOR MANUFACTURING A DISPLAY

[75] Inventor: Douglas I. Lovison, Rancho Santa Fe, Calif.

[73] Assignee: Chromium Graphics, San Diego, Calif.

[21] Appl. No.: 774,906

[22] Filed: Dec. 27, 1996

Related U.S. Application Data

[63] Continuation-in-part of Ser. No. 670,626, Jun. 25, 1996, which is a continuation-in-part of Ser. No. 382,132, Feb. 1, 1995, abandoned.

[51] Int. Cl.[6] ..... B41F 15/42; B41F 13/00

[52] U.S. Cl. ..... 101/491; 101/181; 101/211; 101/128.21; 101/129; 156/184

[58] Field of Search ..... 101/491, 487, 101/490, 424.1, 211, 115, 119, 129, 128.21; 428/13, 29; 156/184

[56] References Cited

U.S. PATENT DOCUMENTS

| | | | |
|---|---|---|---|
| 1,694,847 | 12/1928 | Donaldson . | |
| 1,867,314 | 7/1932 | Gurwick . | |
| 3,442,742 | 5/1969 | Jorgensen . | |
| 3,622,439 | 11/1971 | Manne et al. . | |
| 3,735,730 | 5/1973 | Mitter . | |
| 3,840,421 | 10/1974 | Peterson . | |
| 4,051,776 | 10/1977 | Zimmer . | |
| 4,092,449 | 5/1978 | Bernstein | 428/29 |
| 4,141,929 | 2/1979 | Stoops et al. . | |
| 4,379,185 | 4/1983 | Smith et al. | 101/115 |
| 4,499,126 | 2/1985 | Suzuki et al. . | |
| 4,500,374 | 2/1985 | Nakazima . | |
| 4,510,863 | 4/1985 | Blaak et al. | 101/219 |
| 4,709,631 | 12/1987 | Davey, Jr. et al. | 101/129 |
| 4,933,218 | 6/1990 | Longobardi . | |
| 4,939,992 | 7/1990 | Bird | 101/211 |
| 5,106,126 | 4/1992 | Longobardi et al. . | |
| 5,118,663 | 6/1992 | Woolf et al. . | |
| 5,132,148 | 7/1992 | Reafler . | |
| 5,145,626 | 9/1992 | Bastioli et al. . | |
| 5,223,357 | 6/1993 | Lovison . | |
| 5,296,340 | 3/1994 | Tsukada et al. . | |
| 5,316,609 | 5/1994 | Guither et al. . | |
| 5,325,781 | 7/1994 | Dupont et al. | 101/487 |
| 5,328,738 | 7/1994 | McKillip et al. | 101/424.1 |
| 5,333,549 | 8/1994 | Feldman . | |
| 5,383,403 | 1/1995 | Nordvall | 101/424.1 |
| 5,407,711 | 4/1995 | Lovison et al. | 428/13 |
| 5,443,557 | 8/1995 | Hasegawa . | |
| 5,540,875 | 7/1996 | Rubio . | |
| 5,606,914 | 3/1997 | Borgardt et al. | 101/491 |

FOREIGN PATENT DOCUMENTS

| | | | |
|---|---|---|---|
| 0194128 | 9/1986 | European Pat. Off. | 101/424.1 |

OTHER PUBLICATIONS

New Inks Boost Use Of Infrared Dryers on Sheet–Fed Offset Printing Presses; Inland Printer/American Lithography, Jun. 1976, pp. 49–50.

*Primary Examiner*—Eugene H. Eickholt
*Attorney, Agent, or Firm*—Nydegger & Associates

[57] ABSTRACT

A system and a method for producing displays such as signs and cards includes a substrate of material which is transferred from a supply roller to a first receiving unit. During the transfer, the substrate passes a series of color printing stations which applies a four-color image to the substrate, an opaque printing station which applies a layer of opaque ink to selected portions of the four-color image, a thick printing station which applies a pattern of viscous translucent ink to form extraordinarily thick ridges of translucent ink on the substrate. Finally, a metalized substance is applied to the substrate over the various ink layers using vapor metalization. As provided herein, the metalized substance is applied to the substrate during transfer of the substrate from the first receiving unit to a second receiving unit.

21 Claims, 2 Drawing Sheets

Figure 1
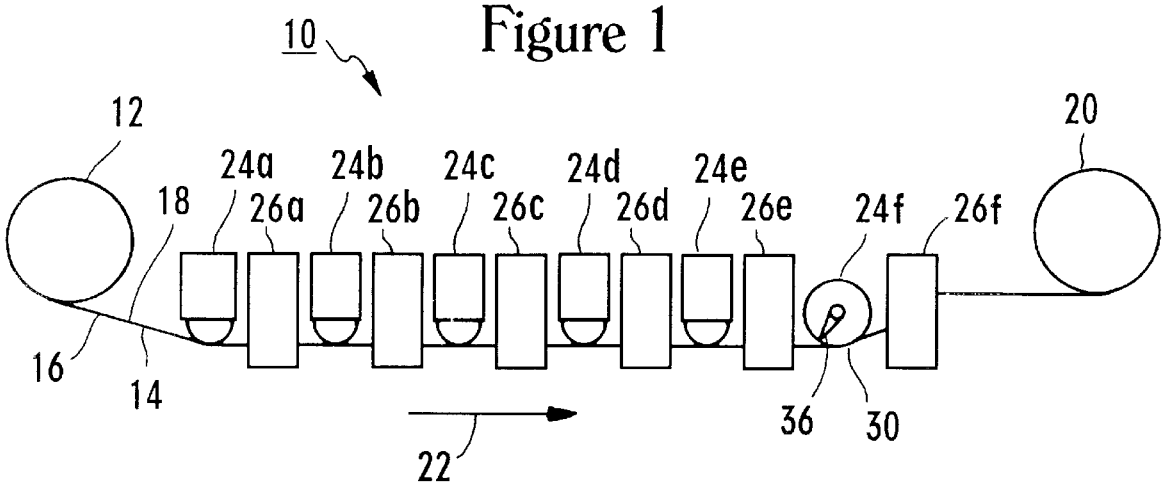
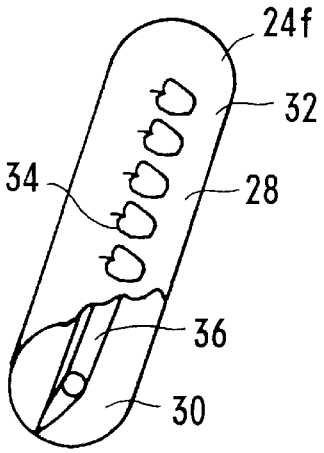
Figure 2
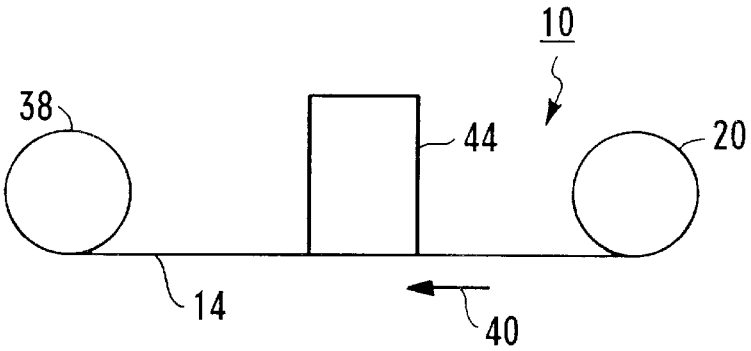
Figure 3

METHOD FOR MANUFACTURING A DISPLAY

This is a continuation-in-part patent application of co-pending U.S. patent application Ser. No. 08/670,626 filed on Jun. 25, 1996 and entitled "Method for Manufacturing a Display" which is a continuation-in-part patent application of U.S. patent application Ser. No. 08/382,132, filed on Feb. 1, 1995, and entitled "Method For Manufacturing a Display," now abandoned.

FIELD OF THE INVENTION

The present invention relates generally to the fabrication of printed materials. More specifically, the present invention relates to methods for continuous production of printed displays including signs and cards and their packaging. The present invention is particularly, but not exclusively, useful as a continuous, roll-to-roll, method for producing metalized cards with enhanced highlights.

BACKGROUND OF THE INVENTION

In the past, the manufacture of displays, such as signs and cards, has generally been performed using a step-by-step, or piecemeal, methodology. Methodologies of this type start with a substrate material upon which a design is to be printed. The substrate is positioned in a printing, or inking station, and a layer of colored ink is applied. The substrate is then moved to a second printing station where a second layer of colored ink is applied. The process of moving the substrate and applying layers of ink is repeated until the desired number of layers have been applied and the design is complete. Often, a so-called four-color process is used where layers of red, yellow, blue, and black inks are sequentially applied. Each of the layers consists of a distinct pattern of dots. The complimentary interaction between the differing dot patterns, each composed of a separate color, results in a full-color image on the substrate surface.

Generally, step-by-step methodologies are subject to a number of operational disadvantages. For instance, it may be appreciated that each printing station will experience idle periods while it waits for a new substrate to be loaded. As a result, the manufacturing process is slowed and, consequently, the cost of manufacturing the display is increased.

To alleviate this problem, multiple ink printing systems have been developed. These systems allow multiple layers of ink to be applied by the same printing station. This reduces the number of delays attributable to the process of moving the substrate to successive printing stations. Unfortunately, these systems have proven to be both complex and expensive, limiting the applicability of these systems, especially in cases where production of a low cost product is essential.

A second method for increasing the speed and efficiency of traditional printing systems involves the employment of specialized handling equipment for moving the display substrates between the various printing subsystems. Equipment of this type speeds the manufacturing process by decreasing the delays experienced at each printing station while it waits for a new substrate to be loaded. Equipment of this type, however, is expensive to produce, is expensive to use and must be carefully designed to avoid damage to the printed design as the substrate moves through the manufacturing process.

A third method for increasing the speed and efficiency of traditional printing systems involves the use of a larger substrate and replication of the display design to produce multiple designs on a single substrate. At the completion of the printing process, the substrate is partitioned and multiple displays are produced. The technique of replication may also be efficiently employed where multiple designs are desired. In practice, however, the replication technique is inherently limited by the difficulty involved in handling large substrates.

In light of the above, it is an object of the present invention to provide a system and a method for manufacturing displays which operates as a continuous and on-going process. It is another object of the present invention to provide a system and a method for manufacturing displays capable of reliably maintaining a high production rate. Yet another object of the present invention is to provide a system and a method for manufacturing displays which functions without the need for expensive or complex handling equipment. Still another object of the present invention is to provide a system and a method for manufacturing displays which is relatively simple to use, is relatively easy to implement and is comparatively cost effective.

SUMMARY

The present invention is an in-line system for manufacturing displays, such as signs and trading cards. Structurally, the present invention includes a supply roller, initially wound with a substantially clear plastic substrate, a first receiving unit, which is initially empty and a second receiving unit which also is initially empty. The substrate has a first side and a second side and can be a substantially clear plastic. The substrate is initially connected to the first receiving unit so that the substrate may be transferred from the supply roller to the first receiving unit by revolving the first receiving unit. Subsequently, the substrate can be transferred from the first receiving unit to the second receiving unit.

As the substrate moves between the supply roller and the first receiving unit, it passes sequentially through six printing stations, each followed by a curing oven. Four of the six printing stations are color printing stations which apply a reverse printed, four-color image to the second side of the substrate. More specifically, within the four, color printing stations, separate patterns of translucent black, translucent yellow, translucent blue and translucent red inks are applied to the second side of the clear substrate. The combined effect of the four patterns and four colors is to produce a life-like image, or pattern, on the moving substrate.

In general, it should be appreciated that the a wide range of differing printing technologies may be used to implement the first four printing stations. In fact, the present invention may utilize any printing technology which can be used to apply the required four-color image to the moving substrate.

One of the six printing stations is an opaque printing station. The opaque printing station applies a pattern of substantially opaque ink to the second side of the substrate. The opaque ink is preferably white in color and is applied to create masked, and unmasked, portions of the substrate. Like the color printing stations, the opaque printing station may be implemented using a wide range of differing printing technologies.

The remaining printing station is a thick printing station which applies a thick, or extraordinarily thick, layer of translucent ink in a selected pattern on the second side of the substrate. The translucent ink is preferably of the U.V. curable type and the pattern of ink gives portions of the substrate a textured, or multi-dimensional, appearance.

Importantly, the translucent ink used in this step must be viscous enough to prevent spreading of the ink on the substrate prior to the substrate entering the curing oven which follows the thick printing station. This allows the pattern produced by the viscous ink to have clearly defined, or registered, edges and enhances the multi-dimensional effect produced by the translucent ink pattern.

To work in combination with the viscous translucent ink, the thick printing station is preferably implemented as a cylindrical rotating silk screen. The cylindrical screen is positioned to revolve in contact with the second side of the substrate as it moves from the supply roller to the first receiving unit.

Importantly, the revolving motion of the cylindrical screen is maintained so that the tangential velocity of the screen substantially equals the linear velocity of the moving substrate. Ink is passed under pressure into the rotating screen and is spread over the inside of the rotating screen by a non-moving blade. As the screen revolves, the ink within the screen moves through a pattern of holes in the surface of the screen. The ink is then applied as a patterned layer of ink dots onto the second side of the clear substrate.

The viscosity of the translucent ink requires that the silk screen used in the thick printing station have a relatively coarse mesh size. Preferably, in fact, a screen which has a mesh size of approximately two-hundred lines per inch is used. The construction of extraordinarily thick ink ridges is described more fully in U.S. Pat. No 4,933,218 which issued to Longobardi for an invention entitled "SIGN WITH TRANSPARENT SUBSTRATE," which is incorporated herein by reference.

Next, a metalized substance is applied onto the substrate, over the translucent inks, the opaque ink and the viscous translucent ink. The metalized substance imparts a metallic appearance to those areas of the substrate which have not been masked by the pattern of opaque ink previously applied.

The metalized substance can be applied to the substrate using vapor metalization. Vapor metalization involves the use of vapor to deposit a thin metal film onto the substrate. As provided herein, the metalized substance can be applied to the substrate during transfer of the substrate from the first receiving unit to the second receiving unit.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1 is a schematic depiction of a portion of a device having features of the present invention;

FIG. 2 is an isometric view of the rotating screen of the present invention shown with portions removed to reveal the fixed blade of the present invention;

FIG. 3 is a schematic depiction of another portion of a device having features of the present invention;

DESCRIPTION

Figure 4:
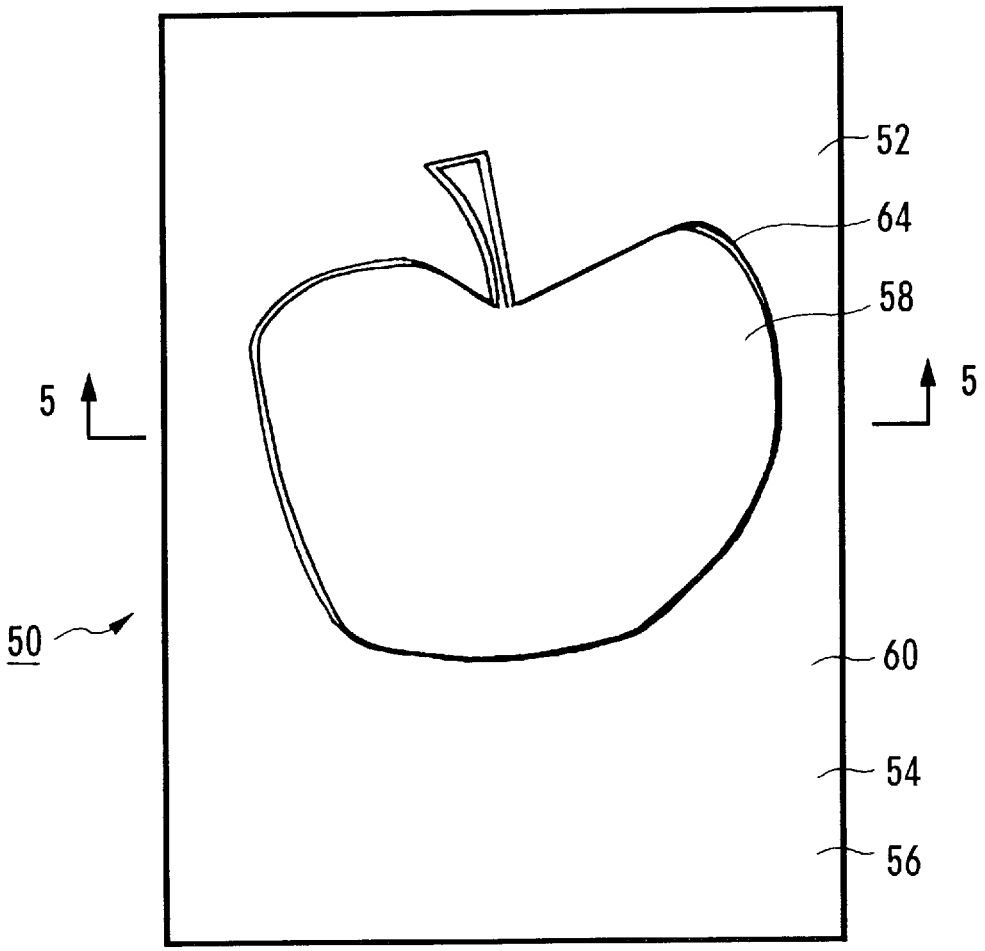
FIG. 4 is a front elevational view of a display as produced by the present invention.

The present invention is a two stage, in-line system for manufacturing displays, such as signs and trading cards. The structural details of the first stage of the present invention may be better appreciated by reference to FIG. 1 where the apparatus of the present invention is shown and generally designated 10. The structural details of the second stage of the present invention are best appreciated by reference to FIG. 3.

Referring to FIG. 1, the apparatus 10 includes a supply roller 12 which is initially wound with a substrate 14. The substrate 14 has a first side 16 and a second side 18 and is preferably composed of clear or translucent plastic. The substrate 14 is connected to a first receiving unit 20, which is typically a roller. Revolution of the first receiving unit 20 causes the substrate 14 to unwind from the supply roller 12 and pass to the first receiving unit 20. The direction of movement of the substrate 14 between the supply roller 12 and the first receiving unit 20 is indicated by the arrow 22.

A series of six printing stations 24*a*–24*f* and a series of six curing ovens 26*a*–26*f* are positioned between the supply roller 12 and the first receiving unit 20. The printing stations 24*a*–24*f* and the curing ovens 26*a*–26*f* are interleaved, so that the substrate 14 passes through a curing oven 26*a*–26*f* after passing each printing station 24*a*–24*f*.

The first four printing stations 24*a*–24*f* are color printing stations. The color printing stations are designed to apply a reverse printed four-color image to the second side 18 of the substrate 14. As is well known in the pertinent art, application of a four-color image is performed by separately depositing patterns of black, yellow, blue and red translucent inks to the substrate 14.

As is also well known in the pertinent art, a range of differing printing technologies, such as intaglio rollers or rotating silk-screens, may be used to apply the ink patterns required for a four-color image. For the purposes of the present invention, any technology which produces the required four-color image at the required resolution may, therefore, be utilized to implement the color printing stations 24*a*–24*d*.

The next printing station 24*e* shown in FIG. 1 is an opaque printing station. The opaque printing station applies a pattern of opaque ink on selected portions of the second side 18 of the substrate 14. The opaque ink is preferably white in color and is applied to establish masked, and unmasked, portions of the substrate 14. The opaque printing station 24*e*, like the color printing stations 24*a* through 24*d*, may be implemented using any suitable printing technology.

The remaining printing station 24*f* shown in FIG. 1 is a thick printing station. The thick printing station applies a pattern of thick, or extraordinarily thick, translucent ink ridges to selected portions of the second side 18 of the substrate 14. Aesthetically, the extraordinarily ridges serve to provide texture, or to impart a multi-dimensional quality to the image being constructed on the substrate 14. To maintain the proper texture or multi-dimensional quality, however, the translucent ink must be prevented from spreading on the substrate 14. This is accomplished by requiring that the translucent ink be relatively viscous.

The structural details which allow the thick printing station 24*f* to work in combination with the viscous translucent ink may be better appreciated by reference to FIG. 2. In FIG. 2, it may be seen that the thick printing station 24*f* is constructed as a cylindrical silk screen 28. The cylindrical silk screen 28 has an interior surface 30 and an exterior surface 32.

A representative pattern of an outline of an apple, is shown on the surface 32 of the cylindrical silk screen 28, and designated 34. The apple pattern 34 is formed, as is well known in the art of screen printing, by making the cylindrical silk screen 28 transparent to ink at the locations which correspond to the apple pattern 34. Importantly, the mesh size of the cylindrical silk screen 28 is relatively large and is preferably about two-hundred lines per inch. This allows the viscous translucent ink to move through the pattern 34.

A fixed blade 36 is positioned inside of the cylindrical silk screen 28 in contact with the interior surface 28. The assembly of the cylindrical silk screen 28 and fixed blade 36 is mounted so that the cylindrical silk screen 28 rotates and the fixed blade 36 remains motionless. The rotation of the cylindrical silk screen 28 is controlled so that the tangential velocity of the rotating cylindrical silk screen 28 matches the linear velocity of the moving substrate 14.

The viscous translucent ink is supplied under pressure into the interior of the rotating cylindrical silk screen 28. Once inside of the cylindrical silk screen 28, the viscous translucent ink is spread over the interior surface 30 of the cylindrical silk screen 28 where it passes through the pattern 34. As the cylindrical silk screen 28 revolves, the pattern 34 contacts the second side 18 of the moving substrate 14 repeatedly transferring the viscous translucent ink, in the shape of pattern 34 to the second side 18 of the substrate 14.

As previously mentioned, one of the curing ovens 26*a*–26*f* is positioned next to each of the printing stations 24*a*–24*f* so that the substrate 14 passes through one of the curing ovens 26*a*–26*f* after passing one of the printing stations 24*a*–24*f*. Importantly, the type of curing oven 26*a*–26*f* is chosen to match the type of ink deposited by the preceding printing station 24*a*–24*f*. For example, if color printing station 24*a* deposits inks which are heat curable, then a thermal curing oven would be chosen for curing oven 26*a*. For the present invention, it is generally preferably to utilize inks which are curable by exposure to ultra-violet radiation in combination with ultra-violet curing ovens 26*a*–26*f*.

Referring to FIG. 3, the second stage of the present invention includes transferring the substrate 14 from the first receiving unit 20 to a second receiving unit 38. The substrate is transferred from the first receiving unit 20 to the second receiving unit 50 by rotating the second receiving unit 50. The direction of movement of the substrate 14 between the first receiving unit 20 and the second receiving unit 38 is indicated by arrow 40. It will be appreciated by the skilled artisan that the second receiving unit 38 can be a roller or any die cutting, stripping, slitting, scoring, folding or kiss cutting apparatus well known in the pertinent art.

During the transfer from the first receiving unit 20 to the second receiving unit 38, a metalized substance 42 is applied over the translucent inks, the opaque ink and the viscous translucent ink. The metalized substance 42 can be applied by a device 44 which uses a sputter metalization process. Alternately, for example, the device 44 can apply the metalized substance using a thermal vapor metalization process. The process of vapor metalization uses vapor to deposit a thin metal film onto the substrate 14. The sputter metalization process and the thermal vapor metalization process are known to those skilled in the art.

Alternately, the metalized substance 42 can be applied to the substrate 14 prior to being wound onto the first receiving unit 20 and after the viscous translucent ink has been applied to the substrate 14.

OPERATION

Figure 5:
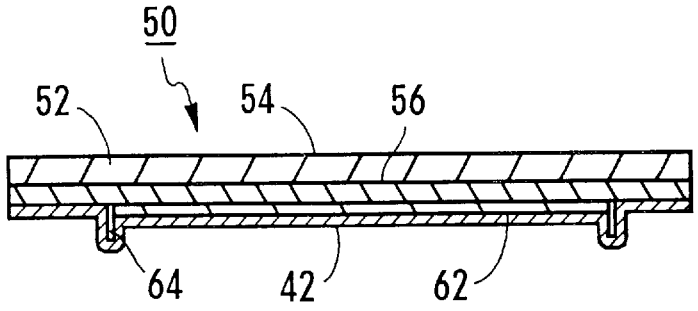
FIG. 5 is a cross-section of the display produced by the present invention as seen along the line 5—5 in FIG. 5.

A representative display, as may be produced by the present invention is shown in FIGS. 4 and 5 and generally designated 50. As may be seen by reference to those figures, the display 50 includes a substantial flat substrate 52 formed from a clear plastic material. The substrate 52 has a first side 54 and second side 56, and for purposes of illustration, is shown with an image of the apple 58 and background 60 printed on the second side 56.

A layer of opaque ink 62 is printed on the second side 56 of the substrate 54, and covers of the apple image 58, but does not cover the background 60. Additionally, an extraordinarily thick ridge 64 is printed on the second side 56 of the substrate 54 at the edge of the apple image 58.

Next, the metalized substance 42 is applied to the second side 56 of the substrate 52 over the image of the apple 58, layer of opaque ink 62 and extraordinarily thick ridge 64. The metalized substance 42 imparts a metallic appearance to those areas of the substrate 52 which are not masked by the layer of opaque ink 62 (i.e., the background 60). At the same time, those areas which are masked by the layer of opaque ink 62 (i.e., the apple image 58) retain a relatively flat appearance.

To construct the display 50, a substrate 14 is wound on the supply roller 12 of the device 10 of FIG. 1. The substrate 14 is a continuous piece of clear or translucent plastic, from which the smaller substrate 54 of FIGS. 4 and 5 may be partitioned. As the substrate 14 passes between the supply roller 12 and the first receiving unit 20, a four-color image is applied by the color printing stations 24*a* through 24*d*. The image is formed of separate patterns of black, yellow, blue and red translucent inks to the substrate 14. The separate patterns combine to form the four-color image which, in the context of the display 50 of FIGS. 3 and 4, corresponds to the apple image 58 and background 60.

The opaque printing station 24*e* then applies a pattern of opaque ink over to the second side 16 of the substrate 14. The opaque ink is preferably white in color and, for the display 50 of FIGS. 4 and 5, forms the opaque white ink 62 layer which is applied over the apple image 58.

For display 50, application of the opaque ink layer 62, is followed by application of extraordinarily thick ridge 64 at the thick printing station 24*f*. As discussed, extraordinarily thick ridge 64 is applied to surround the apple image 58. Importantly, the viscosity of the translucent ink used to form extraordinarily thick ridge 64 prevents spreading of the extraordinarily thick ridge 64 on the substrate 14 prior to curing in oven 26*f*.

Following application of extraordinarily thick ridge 64, the metalized substance 42 is applied to substrate 14. Referring to FIG. 3, this is accomplished by moving the substrate through the vapor metalization device 44. As shown in FIG. 3, the substrate 14 passes through the vapor metalization device 44 while being transferred from the first receiving unit 20 to the second receiving unit 38.

While the particular system and method for manufacturing displays as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

What is claimed is:

1. A method for manufacturing a display which comprises the steps of:

extending a substrate through at least three printing stations between a supply roller and a first receiving unit;

rotating the first receiving unit to transfer the substrate from the supply roller to the first receiving unit;

rotationally depositing substantially translucent inks at a first printing station to form a pattern on the substrate, the pattern being one of a plurality of sequential patterns on the substrate;

rotationally depositing substantially opaque ink at a second printing station onto at least a portion of at least one of the patterns on the substrate;

rotationally depositing viscous, substantially translucent ink at a third printing station to form one or more extraordinarily thick ridges on at least a portion of at least one of the patterns on the substrate;

curing the inks on the substrate; and applying a metalized substance onto the substrate over at least a portion of the translucent inks, the opaque ink and the viscous translucent ink.

2. A method as recited in claim 1 wherein the step of applying a metalized substance includes using vapor metalization to apply the metalized substance.

3. A method as recited in claim 2 wherein said viscous translucent ink is deposited using a single pressurized cylindrical screen having a mesh size of about two-hundred lines per inch.

4. A method as recited in claim 2 comprising the step of transferring the substrate from the first receiving unit to a second receiving unit and wherein the step of applying a metalized substance occurs during the transfer of the substrate from the first receiving unit to the second receiving unit.

5. A method as recited in claim 1 wherein the step of curing the inks occurs after each rotationally depositing step.

6. A method as recited in claim 1 wherein the step of rotationally depositing translucent inks includes the steps of rotationally depositing yellow ink on the substrate, rotationally depositing blue ink on the substrate, rotationally depositing red ink on the substrate, and rotationally depositing black ink on the substrate, as required to generate appropriate colors for the pattern.

7. A method as recited in claim 6 wherein the step of curing the inks occurs after each rotationally depositing step.

8. A method for manufacturing a display which comprises the steps of:

extending a substrate through at least three printing stations between a supply roller and a first receiving unit;

transferring the substrate from the supply roller to the first receiving unit;

rotationally depositing substantially translucent inks at a first printing station to form a pattern on the substrate, the pattern being one of a plurality of patterns on the substrate;

rotationally depositing substantially opaque ink at a second printing station onto selected portions of at least one of the patterns on the substrate;

rotationally depositing viscous, substantially translucent ink at a third printing station to form one or more extraordinarily thick ridges on selected portions of at least one of the patterns on the substrate;

curing the inks on the substrate;

transferring the substrate from the first receiving unit to a second receiving unit; and applying a metalized substance onto the substrate over the translucent inks, the opaque ink and the viscous translucent ink during the transfer of the substrate from the first receiving unit to the second receiving unit using vapor metalization.

9. A method as recited in claim 8 wherein the step of rotationally depositing translucent inks includes the steps of rotationally depositing yellow ink on the substrate, rotationally depositing blue ink on the substrate, rotationally depositing red ink on the substrate, and rotationally depositing black ink on the substrate, as required to generate appropriate colors for the pattern.

10. A method as recited in claim 9 wherein the step of curing the inks occurs after each rotationally depositing step.

11. A device for manufacturing displays on a substrate being transferred from a supply roller to a first receiving unit, the device comprising:

a first printing station adapted for depositing translucent inks to form a pattern on the substrate during transfer of the substrate from the supply roller to the first receiving unit, the pattern being one of a plurality of patterns on the substrate;

a second printing station positioned between the supply roller and the first receiving unit adapted to apply a pattern of opaque ink on a portion of at least one of the patterns on the substrate during transfer of the substrate from the supply roller to the first receiving unit;

a third printing station positioned between the supply roller and the first receiving unit adapted to apply at least one extraordinarily thick ridge of viscous translucent ink on a portion of at least one of the patterns on the substrate during transfer of the substrate from the supply roller to the first receiving unit;

a curing oven positioned between the supply roller and the first receiving unit to cure the inks during transfer of the substrate from the supply roller to the first receiving unit;

a second receiving unit for receiving the substrate from the first receiving unit; and a vapor metalizer for applying a metalized substance using vapor metalization onto the substrate over the translucent inks, the opaque ink and the viscous translucent ink.

12. A device as recited in claim 11 wherein the third printing station is a pressurized cylindrical screen.

13. A device as recited in claim 12 wherein said pressurized cylindrical screen has a mesh size of two-hundred lines per inch.

14. A device as recited in claim 11 wherein the curing oven includes a plurality of lamps each emitting ultra-violet radiation to cure said viscous translucent ink.

15. A device as recited in claim 11 wherein the curing oven includes a plurality of lamps each emitting infrared radiation to cure said viscous translucent ink.

16. A device as recited in claim 11 comprising a curing oven positioned after each printing station.

17. A method for manufacturing a display which comprises the steps of:

extending a substrate through at least three printing stations between a supply roller and a first receiving unit;

transferring the substrate from the supply roller to the first receiving unit;

depositing substantially translucent inks at a first printing station to form a pattern on the substrate, the pattern being one of a plurality of patterns on the substrate;

depositing substantially opaque ink at a second printing station onto at least a portion of at least one of the patterns on the substrate;

depositing viscous, substantially translucent ink at a third printing station to form at least one extraordinarily thick ridge on at least a portion of at least one of the patterns on the substrate; and curing the inks on the substrate.

18. The method of claim 17 including the step of applying a metalized substance onto the substrate.

19. The method of claim 17 including the step of applying a metalized substance onto the substrate over at least a portion of the translucent inks, the opaque ink and the viscous translucent ink.

20. The method of claim 19 wherein the step of applying the metalized substance includes using vapor metalization.

21. A method of claim 19 comprising the step of transferring the substrate from the first receiving unit to a second receiving unit and wherein the step of applying a metalized substance occurs during the transfer of the substrate from the first receiving unit to the second receiving unit.

* * * * *